United States Patent [19]

Horie

[11] 4,069,647

[45] Jan. 24, 1978

[54] DEVICE FOR CRIMPING PROJECTING EDGES OF WRAPPING SHEET IN COIN PACKAGING MACHINE

[75] Inventor: Shozo Horie, Himeji, Japan

[73] Assignee: Glory Kogyo Kabushiki Kaisha, Japan

[21] Appl. No.: 768,318

[22] Filed: Feb. 14, 1977

[30] Foreign Application Priority Data

Feb. 14, 1976 Japan ..... 51-15314

[51] Int. Cl.[2] ..... B65B 11/32; B65B 49/02

[52] U.S. Cl. ..... 53/212; 53/380

[58] Field of Search ..... 53/212, 380, 254; 93/77 R, 81 MT

[56] References Cited

U.S. PATENT DOCUMENTS

| | | | |
|---|---|---|---|
| 2,635,402 | 4/1953 | Jorgensen | 53/212 |
| 3,000,160 | 9/1961 | Speggiorin et al. | 53/212 |

*Primary Examiner*—Travis S. McGehee

*Attorney, Agent, or Firm*—Beveridge, De Grandi, Kline & Lunsford

[57] ABSTRACT

Each of two crimping hooks for crimping projecting edges of a piece of wrapping paper wrapped around a coin stack in a coin package machine has an inner guide surface of a convolute shape designed to curl and crimp positively a respective projecting edge when pressed against that projecting edge, as the wrapping paper is rotated together with the coin stack, the edge thus crimped forming a bead by which the coin stack is tightly packaged in a stably rigid state.

7 Claims, 26 Drawing Figures

DEVICE FOR CRIMPING PROJECTING EDGES OF WRAPPING SHEET IN COIN PACKAGING MACHINE

BACKGROUND OF THE INVENTION

This invention relates generally to coin packaging machines of the type operating to wrap a piece of wrapping sheet material around the cylindrical surface of a stack of a specific number of coins and to fold or roll crimp the projecting edges of the wrapping sheet material radially inward at the two ends of the stack thereby to obtained a rigid packaged coin stack. More particularly, the invention relates to novel crimping hooks for fold or roll crimping the wrapping sheet edges in a coin packaging machine.

Each of the crimping hooks used heretofore in coin packaging machines of the above referred to type has comprised a round bar with its working end curved substantially into a semicircular shape of a crook. In the crimping operation, this crook part of the crimping hook is hooked around one of the projecting side edges of the wrapping sheet wrapped around the cylindrical surface of the coin stack, the inner surface of this crook part thereby straddling that edge. Then, as the coin stack thus wrapped continues to rotate, the crimping hook is moved inward toward the coin stack thereby to fold crimp the wrapping sheet edge radially inward into a tight bead which, together with an identical bead simultaneously formed at the other end of the coin stack by the other crimping hook, holds the coin stack and wrapping sheet therearound as a stably rigid package.

In this fold crimping operation with crimping hooks of the above described shape known in the prior art, each projecting edge 1*a* of the wrapping sheet 1 is first folded inward over itself into a two-layer fold 1*b* as indicated in FIG. 7(A) of the accompanying drawings briefly described hereinafter. Next, this two-layer fold 1*b* is further folded inward over itself into a four-layer fold as indicated in FIG. 7(B).

However, in the case where the wrapping sheet material is not a paper but is a sheet of cellophane, a polyethylene, or the like, or in the case of a long projecting length of the wrapping sheet material edges beyond the ends of the coin stack 2, the above described double fold crimping action is not always achieved. More specifically, the extreme edge 1*c* of the initially folded part 1*b* of the projecting edge of the wrapping sheet material undergoes a sliding motion to extend inward along the outermost surface of the coin stack 2 as indicated in FIG. 7(C). As a consequence, the second fold crimping is not satisfactorily accomplished, and the resulting fold assumes a feeble, unstable state or a defectively crimped state, whereby a stably and rigidly held state of the coin stack 2 cannot be attained. With the coin package in this state, not only is there a possibility of the package unintentionally becoming undone during its handling after packaging, but the visual appearance of the package is also poor.

Furthermore, an edge crimping mechanism wherein, in order to facilitate the fold crimping action, auxiliary crimping hooks are provided in addition to and in front of the above described fold crimping hooks thereby to assist the folding action at a stage prior to the fold crimping by the fold crimping hooks is known.

These known auxiliary crimping hooks, however, are merely members with working ends curved into a semicircular shape similarly as in the case of the main fold crimping hooks. For this reason, when each projecting edge 1*a* of the wrapping sheet 1 is first folded inward over itself into a two-layer fold 1*b* as indicated in FIG. 16(A) and then this two-layer fold 1*b* is further folded inward over itself, the auxiliary crimping hook presses from the edge of the wrapping sheet material toward the outer coin surface of the coin stack 2 in the case where the wrapping sheet 1 is a material such as cellophane or a polyethylene or in the case where the projecting length of the projecting edge is long. As a consequence, the extreme edge 1*c* of the initially folded part 1*b* undergoes a sliding motion to extend along the surface along the outermost coin as indicated in FIG. 16(B), whereby the fold crimping result is unsatisfactory, and not only is there a possibility of the package unintentionally becoming undone during handling after packaging, but the visual appearance of the package is also poor.

SUMMARY OF THE INVENTION

In view of the above described problems, it is an object of this invention to provide crimping hooks of a coin packaging machine of the character referred to above which crimping hooks are capable of fold or roll crimping firmly the projecting edges of a wrapping sheet material wrapped around a coin stack irrespective of the kind of the wrapping sheet material and the projecting length of the projecting edges thereof.

Also in view of the above described problems, it is another object of this invention to provide auxiliary crimping hooks of a coin packaging machine which auxiliary crimping hooks are capable of fold or roll crimping firmly the projecting edges of a wrapping sheet material wrapped around a coin stack irrespective of the kind of the wrapping sheet material and the projecting length of the projecting edges thereof.

According to this invention in one aspect thereof, briefly summarized, there is provided, in a coin packaging machine of the character referred to above, a pair of crimping hook devices, for fold or roll crimping respective projecting edges of the wrapping sheet wrapped around a coin stack, each device having at least one main crimping hook comprising a shank and a curved head joined at a proximal part thereof integrally to the outer end of the shank and extending substantially perpendicular therefrom to a distal end, the curved head having: an inner guide surface of concave arcuate shape as viewed in side view; a concave surface having an arcuate shape as viewed in section taken along a plane passing through the axis of the shank and formed on a side face to contact the wrapping sheet of the curved head at a part thereof near its distal end; a curved tip part formed at the distal end of the curved head; a groove-shaped slide surface formed in and obliquely across the inner guide surface to adjoin at one end thereof the concave surface and to extend to the outer end of the shank on the side thereof opposide from the concave shape, the inner guide surface thereby having a twisted shape; a smooth inclined surface formed at the outer end part of the shank to blend smoothly with the slide surface and facing in the direction opposite to that of the concave surface; and a curved edge surface having an arcuate concave shape as viewed in a direction parallel to the shank and formed on a flank of the curved head facing the center of the coin stack, the shank being positioned closely along side and substantially parallel to the wrapped coin stack, the curved head being positioned obliquely across one projecting edge of the wrapping sheet, in which position the projecting edge is compelled to slide against and along the groove shaped slide surface and thus be roll or fold crimped inward.

According to this invention in another aspect thereof, there is provided a pair of crimping hook devices, each device having a main crimping hook as described above and an auxiliary crimping hook fixed in position relative to the main crimping hook and positioned on the inner side of the corresponding projecting edge of the wrapping sheet and upstream from the main crimping hook with respect to the moving direction of the sheet.

The nature, utility, and further features of this invention will be more clearly apparent from the following detailed description with respect to preferred embodiments of the invention when read n conjunction with the accompanying drawings, throughout which like parts are designated by like reference numerals.

DETAILED DESCRIPTION OF THE INVENTION

Figure 1:
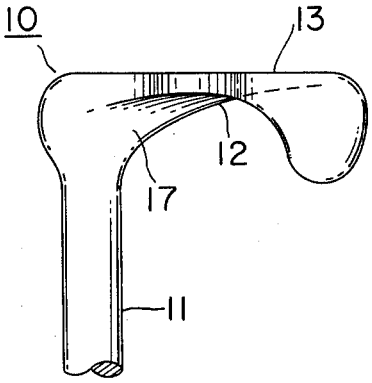
FIG. 1 is an enlarged elevation showing the working end or head of a first example of a crimping hook according to this invention.
Figure 2:
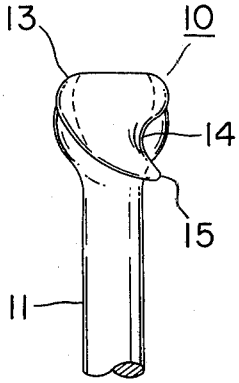
FIG. 2 is an enlarged elevation orthogonal to FIG. 1.
Figure 3:
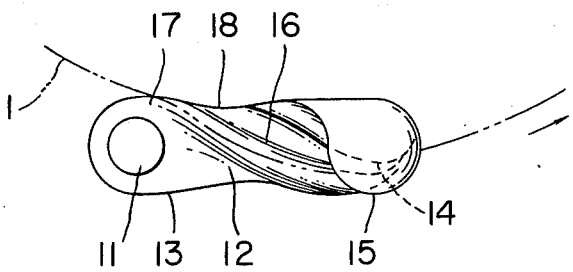
FIG. 3 is an enlarged plan view of the head of the crimping hook shown in FIG. 1 as viewed from below.
Figure 4:
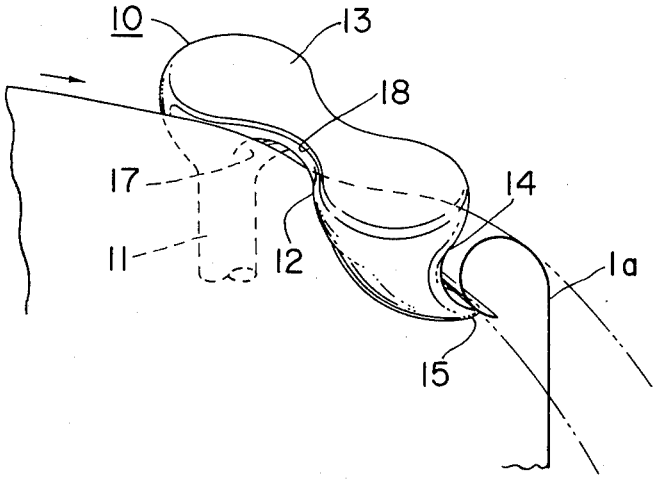
FIG. 4 is an enlarged perspective view indicating the manner in which the same crimping hook used as the upper crimping hook curls inward the upper projecting edge of the wrapping sheet.

In a first embodiment of this invention as illustrated in FIGS. 1 through 5, the crimping hook 10 is made of a metal material and formed to have a straight shank 11 and a curved head 13 formed integrally with the shank 11 and extending from its root part, where it joins the shank 11, outward in a direction substantially perpendicularly to the shank 11 to an outer tip 15. The curved head 13 has an inner guide surface 12 (lower surface as viewed in FIG. 1) which has a substantially arcuate concave shape in side view. This curved head 13 has, at a part thereof near its outer tip, a concave surface 14 having a concave arcuate shape as viewed in vertical section from the side and adapted to contact the inner surface of the projecting edge 1*a* of the wrapping sheet material 1 projecting beyond each end of the coin stack 2 as shown in FIGS. 2 and 4. The extreme distal end of the curved head 13 is further curved to project laterally at its tip 15 toward the inner surface of the wrapping sheet material 1.

In and obliquely across the inner guide surface 12, there is formed a groove-shaped slide surface 16, which at one end thereof smoothly adjoins the above described surface 14, and which extends to the upper end of the shank 11 on the side thereof opposite from the concave surface 14. Thus, this inner guide surface 12 has a shape which has a twisted appearance. At the upper end portion of the shank 11, the end part of the groove-shaped slide surface 16 is formed as a smooth inclined surface 17 facing in the direction opposite to that of the concave surface 14 and blending smoothly with the surface of the upper end of the shank 11.

The flank of the curved head 13 on its side to which the extreme edge of the projecting edge 1*a* of the wrapping sheet material 1 is guided is formed with a curved edge part 18 of an arcuate concave shape as viewed in plan view as indicated in FIG. 4. This curved edge part 18 at its part joining the flank of the curved head 13 is formed as a smooth, fair curved surface, one part of which has a shape following the groove-shaped slide surface 16 and is conformably adapted to the surface of the projecting edge 1*a* of the wrapping sheet material 1.

Figure 6:
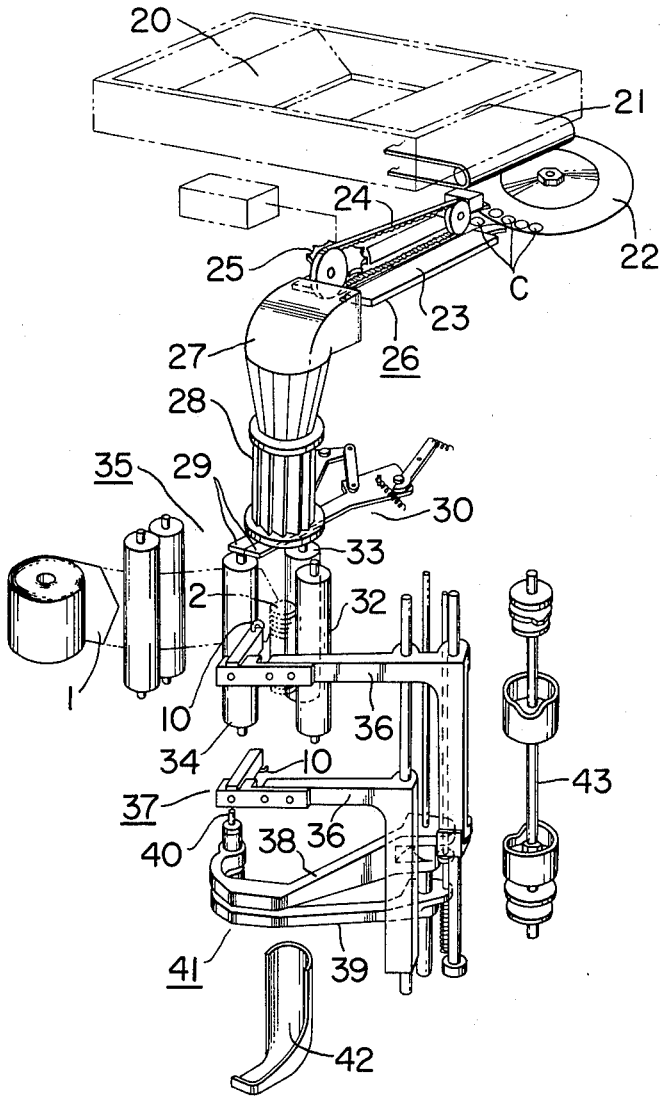
FIG. 6 is perspective showing only the essential parts and their arrangement of an example of a coin packaging machine in which the crimping hooks of this invention can be effectively used.
Figure 7A:
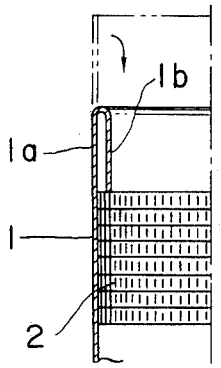
FIG. 7(A) is a fragmentary elevation, in vertical section, showing a coin stack wrapped with a wrapping sheet having a projecting edge which has been intially folded inward once over itself.

Crimping hooks 10 of the above described construction are advantageously employed in a coin packaging machine, one example of which is illustrated in simplified form in FIG. 6 and will now be briefly described, particularly with respect to the operations of its principal parts.

Coins C to be packaged are dropped into a hopper 20, from which they are conveyed by a feeding belt 21 onto a revolving turntable 22, where the coins C are aligned by centrifugal force along a peripheral wall (not shown). The coins C are then successively sent from the turntable 22 into a coin passage 23, along which they are moved by an endless propelling belt 24. During this movement of the coins along the coin passage 23 they are counted by a counting mechanism 25. The above mentioned parts from the hopper 20 through the counting mechanism 25 constitute a coin feeding device 26.

From this coin feeding device 26, a specific number of coins which have been counted are successively passed through a guide duct 27 and successively dropped into a coin stacking cylinder 28, where they are aligned into a neat stack. The bottom of the stacking cylinder 28 is closed by shutter plates 29, 29 of a shutter mechanism 30 until the above mentioned specific number of coins have been stacked. The shutter plates 29, 29 are then opened, and the coin stack 2 is lowered to a wrapping position in the space between wrapping rollers 32, 33, and 34 of a coin wrapping device 35. The wrapping rollers 32, 33, and 34 operate to move inward toward the coin stack 2 and to clamp the same therebetween, thus imparting rotation to the coin stack 2. A piece of wrapping sheet material 1 supplied from a sheet material supplying mechanism is introduced between the coin stack 2 and the three wrapping rollers and, moving along guide members (not shown) is wrapped around the cylindrical surface of the coin stack 2.

The length of this piece of wrapping sheet material 1, i.e., the dimension in the circumferential direction of the coin stack 2, is preset at a value suitable for packaging the coin stack. The width of this sheet material 1, i.e., the dimension perpendicular to the length, is also preset at a value to produce side projecting edges 1*a*, 1*a* of the sheet material 1 projecting beyond the two ends of the coin stack 2 thus wrapped therewith by a distance sufficient for crimping the projecting edges 1*a*, 1*a* into satisfactory beads.

These projecting edges are crimped inward by a crimping device 37 comprising the aforedescribed crimping hooks 10, 10 and arms 36, 36 respectively supporting the crimping hooks 10, 10 and operating to swing in synchronism to move the crimping hooks 10, 10 to positions confronting the projecting edges 1*a* of the wrapping sheet material 1 and then to move the crimping hooks toward each other so as to engage the projecting edges 1*a* and carry out the crimping operation as described more fully hereinafter.

At the time when the shutter plates 29, 29 are opened, as described above to release a coin stack 2 from the coin stacking cylinder 28, the coin stack 2 is immediately received by the upper end of a support rod 40 held by arms 38 and 39 of a coin stack supporting device 41, the arms 38 and 39 and the support rod 40 having been raised to the upper standby position immediately below the shutter plates 29, 29 to await the release of the coin stack 2. The arms 38 and 39 and the support rod 40, together with the coin stack 2 resting thereon, are then lowered to a position where the coin stack 2 is in the wrapping position between the wrapping roller 32, 33, and 34. The coin stack 2 is thus held by the coin stack supporting device 41 in this wrapping position throughout the wrapping operation and edge crimping operation. Upon completion of the edge crimping step, that is, upon completion of the coin packaging operation, the securely packaged coin stack is dropped into a chute 42 to be transferred to a dispensing position.

The operations of the various above described parts of the coin packaging machine are carried out with coordinated timing by means such as a cam system 43 and gears.

Figure 5:
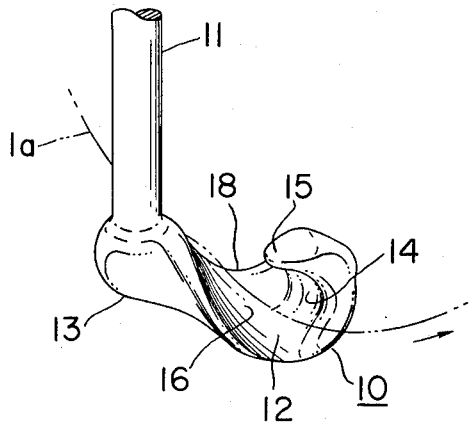
FIG. 5 is an enlarged perspective view indicating the manner in which the same hook used as the lower crimping hook engages the lower edge of the wrapping sheet.

The manner in which each of the crimping hooks 10 crimps the projecting side edge 1*a* of the wrapping sheet material will now be described in greater detail. As illustrated in FIG. 5, when a crimping hook 10 is brought into straddling engagement with a projecting side edge 1*a*, the distal end part of the curved head 13 of the crimping hook 10 is positioned on the radially inner side of the projecting edge 1*a*, which is in the form of a cylindrical ring, as viewed in plan view, while the proximal end part of the curved head 13 and the shank 11 are positioned on the outer side of the projecting edge 1*a*.

Thus the curved head 13 is straddling the extreme edge of the projecting edge 1*a* in an oblique direction thereto as viewed in plan view. Consequently, as the wrapped coin stack continues to be rotated, the extreme edge (as indicated by two-dot chain line in FIGS. 3 and 5) of the wrapped sheet material 1 slides from the aforementioned curved surface 14 and along and in contact with the curved edge part 18, the deepest part of the groove-shaped slide surface 16, and the inclined surface 17 blending with the upper part of the shank 11.

Figure 8A:
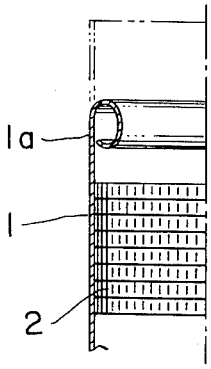
FIG. 8(A) is a view similar to FIG. 7(A) showing the manner in which a projecting edge of a wrapping sheet is curled inward at the initial stage of the crimping action by a crimping hook of the invention.
Figure 7B:
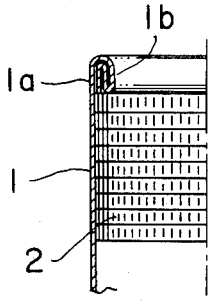
FIG. 7(B) is a view similar to FIG. 7(A) showing the folded projecting edge further folding inward over itself to form a four-layer fold.

Then, as the crimping hook 10 moves parallelly to the centerline axis of the coin stack 2 closer toward the coin stack, the part of the curved surface 14 at the extreme tip 15 contacts and slides along the inner surface of the sheet material 1, and the extreme edge of the wrapping sheet material 1 contacting and sliding along the groove-shaped slide surface 16 is compelled by its movement in the arrow direction in FIG. 5 relative to the crimping hook 10 to follow the twisted or convolute shape of the slide surface 16 and thereby to be curled progressively inward to form a roll as shown in FIG. 8(A).

More specifically, the projecting edge part 1*a* of the wrapping sheet material 1 is introduced into contact with the curved head 13 of the crimping hook 10 along the inclined surface 17 thereof and, as it traverses obliquely across the curved head 13 along the groove-shaped slide surface 16, it is curled progressively inward by the slide surface 16 and the curved edge part 18 at the flank part of the curved head 13 as indicated in FIG. 4. The convolute curved part of the projecting edge 1*a* thus formed by this curling action then contacts the concave surface 14 of the curved head 13 to be accommodated in the concavity thereof and, at the same time, is pressed outward by this concave surface 14, thereby being further rolled.

Figure 8B:
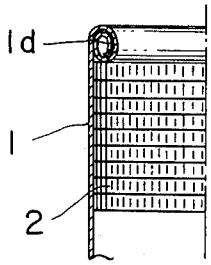
FIG. 8(B) is a view similar to FIG. 8(A) showing the sheet edge further rolled into a bead.
Figure 7C:
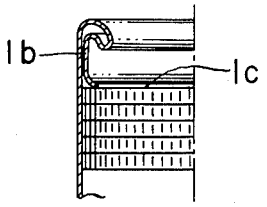
FIG. 7(C) is a view similar to FIG. 7(A) showing a defective fold crimped state of the projecting edge.
Figure 10:
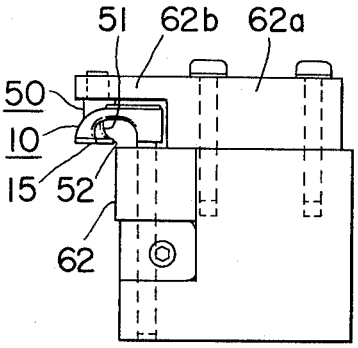
FIGS. 9, 10, 11 and 12 are respectively a side elevation, an opposite side elevation, a front end elevation, and a plan view of a second example of a crimping hook device according to this invention in which an auxiliary crimping hook is used in addition to a main crimping hook.
Figure 9:
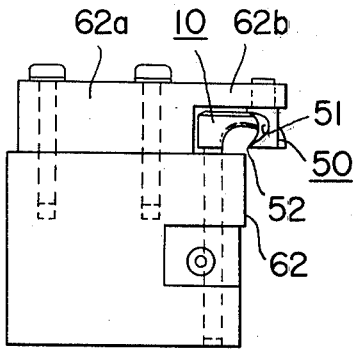
Figure 12:
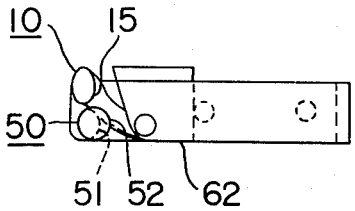
Figure 11:
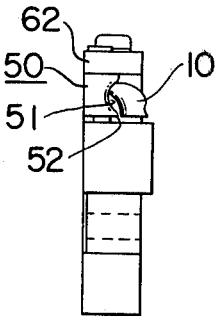
Figure 15:
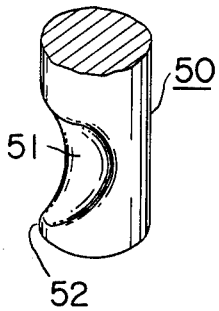
FIG. 15 is an enlarged perspective view of an auxiliary crimping hook.

During the above described sheet edge rolling action, projecting edge 1*a* is progressively introduced into the groove-shaped slide surface 16 by the inclined surface 17 and the curved edge part of the curved head 13 and, from the slide surface 16, is gradually guided to and along the concave surface 14, thereby being rolled. Accordingly, the projecting edge 1*a* of the wrapping sheet material is not subjected to any violent or undue folding or like action but is rolled in a smooth natural manner. This smooth rolling action proceeds until the extreme tip of the curved head 13 of the crimping hook 10 strikes against the end face of the coin stack 2, at which time, the projecting edge 1*a* is completely roll crimped inward to form a roll-crimped bead 1*d* as indicated in FIG. 8(B). This roll-crimped bead 1*d* functions to press firmly against the peripheral part of the end face of the coin stack 2 thereby to hold the coin stack in a stably rigid and tightly packaged state in cooperation with the identical bead at the other end of the coin stack.

Upon completion of the above described coin packaging step, the wrapping rollers 32, 33, and 34 mutually separate, and the arms 38 and 39 of the coin stack supporting device descend and then swing outward thereby to release the packaged coin stack and permit it to be discharged into the chute 42.

The inner guide surface 12 of the curved head 13 of each crimping hook 10 is preferably so shaped that its radius of curvature as viewed in side view is larger at the proximal part of the curved head 13 joining the shank 11 and is smaller at the distal end part thereof. I have found that this feature affords an even better roll crimping action. Furthermore, the structural organization of the coin packaging machine is not limited to that illustrated in FIG. 6 but may be of any form provided that it uses crimping hooks in the coin packaging step.

By the use of crimping hooks according to this invention of the shape and roll-crimping action as described above in detail, the projecting edge of the wrapping sheet material can be roll crimped positively and accurately irrespective of the material of the wrapping sheet material, whether it is paper, cellophane, a polyethylene, or some other suitable material, and irrespective of the distance of projection of the projecting edge beyond the coin stack. Furthermore, the crimping hooks of the invention afford an increase in the firmness with which the coin stack is held by the wrapping material, neat appearance of the roll-crimped bead, and, moreover, an increase in the exposed area of the outer end surface of the coin stack due the compactness of the roll-crimped bead, whereby identification of the kind or denomination of the coins in the coin stack is facilitated. It is also possible, when the projecting distance of the projecting edge 1*a* is large, to place it in folded state only in the first action and then to roll crimp the sheet material from the resulting outer edge.

Figure 13:
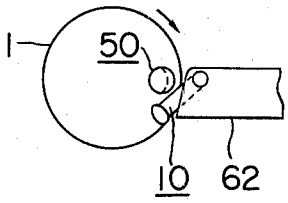
FIG. 13 is a schematic diagram in plan view indicating the positional relationships between a main crimping hook, an auxiliary crimping hook, and a wrapping sheet wrapped around a coin stack.
Figure 16A:
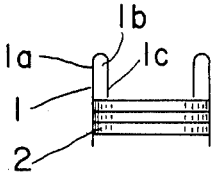
FIGS. 16(A), 16(B), and 16(C) are diagrammatic side views, in vertical section, respectively indicating progressive stages in the fold crimping of a projecting edge of a wrapping sheet.
Figure 16B:
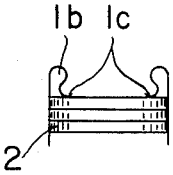
Figure 16C:
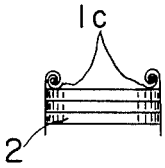

In a second embodiment of this invention as illustrated in FIGS. 9 through 17, each main crimping hook 10 is the same as the crimping hook 10 in the preceding first embodiment of the invention but is held at its shank part by a holder 62 of block form. In addition, an auxiliary crimping hook 50 is provided in the vicinity of each main crimping hook 10 at a position upstream therefrom with respect to the movement of the wrapping sheet material and on the inner side of the annular projecting edge 1*a* during crimping operation as indicated in FIG. 13. The auxiliary crimping hook 50 is imbeddedly fixed at its root part to the outer end of a cantilever support beam $62_b$ projecting horizontally from a head block $62_a$ fixed to the holder 62.

This auxiliary crimping hook 50 is of substantially cylindrical shape with a recessed, smoothly curved surface 51 formed in its side and facing in the same direction as the groove-shaped slide surface 16 of the main crimping hook 10. At the outer end of this curved surface 51, the auxiliary crimping hook 50 is formed to have a projecting edge part 52 which, at the same height position as the tip 15 of the main crimping hook 10, projects further toward the inner side of the wrapping sheet than the tip 15.

Figure 14:
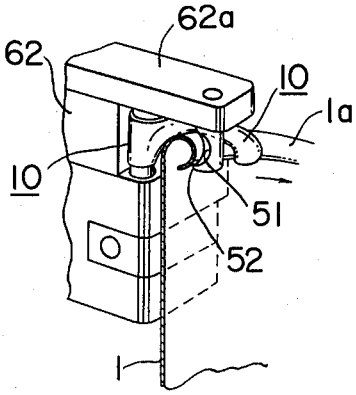
FIG. 14 is a fragmentary perspective view, with a wrapping sheet shown in vertical section, indicating the manner in which the main and auxiliary crimping hooks roll a projecting edge of the wrapping sheet.

At the time of crimping operations each pair of main and auxiliary crimping hooks engage the projecting edge 1*a* of the wrapping sheet material 1 in a state, as indicated in FIGS. 13 and 14 wherein the distal end of the curved head 13 of the main crimping hook 10 and the projecting edge part 52 of the auxiliary crimping hook 50 are positioned on the inner side of the projecting edge 1*a*. Accordingly, the extreme edge of the projecting edge 1*a* slides from the concave surface 14 along the curved edge part 18 and the deepest part of the groove-shaped slide surface 16 of the main crimping hook 10 as indicated in FIG. 3 and slidingly contacts the inclined surface 17 formed at the outer end of the shank 11.

Figure 17A:
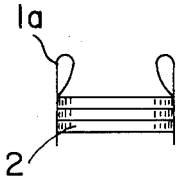
FIGS. 17(A), 17(B), and 17(C) are diagrammatic side views similar to FIGS. 16(A), 16(B), and 16(C) indicating excellent fold crimping accomplished by the crimping hooks according to the invention.

Then, as the main crimping hook 10 moves parallelly to the centerline axis of the coin stack 2 toward the end of the coin stack, the tip 15 at the extremity of its concave surface 14 abuts against and slides along the inner surface of the wrapping sheet 1, and the extreme edge of the sheet sliding along the groove-shaped slide surface 16 is progressively curled and folded inward as indicated in FIG. 17(A) as it is compelled to follow the twisted form of this slide surface by the movement of the extreme edge of the sheet relative to the main crimping hook 10 as indicated by the arrow in FIG. 13 until the projecting edge 1*a* is folded over itself. This folding action is substantially the same as the rolling action described hereinbefore with respect to the preceding embodiment of the invention and is accomplished smoothly and naturally without any violent or undue folding or like action.

Figure 17B:
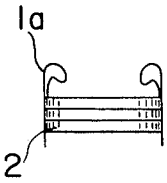
Figure 17C:
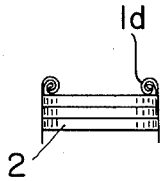

On one hand, when the folded or curled part of the sheet 1 formed by the above described operation of the main crimping hook 10 rotates through one revolution as a result of the rotation of the coin stack 2 and arrives again at the position of the main crimping hook 10, it is guided into aforementioned the recessed smoothly curved surface 51 of the auxiliary crimping hook 50. At the same time, the projecting edge part 52 at the outer end of the curved surface 51 presses in the outward direction the folded edge 1*c* of the projecting edge 1*a*, which has been folded, as indicated in FIG. 14. As a consequence, the edge part 1*c* is transferred to the main crimping hook 10 in a state wherein the edge 1*c* is prevented from being displaced toward the center as indicated in FIG. 17(B) before it reaches the main crimping hook 10. Therefore, as the main crimping hook 10 moves further toward the coin stack, the edge part 1*c* is rolled crimped as indicated in FIG. 17(C) without the extreme edge being displaced out of the roll.

As the above described operation proceeds, the inward rolling of the projecting edge 1*a* of the wrapping sheet 1 which has been folded once progresses, and the distal end of the curved head 13 of the main crimping hook 10 advances until it strikes the surface of the coin at the end of the coin stack 2. At this time, the projecting edge part 1*a* is completely rolled inward to form a rolled bead 1*d* as indicated in FIG. 17(C), which functions together with a similar bead at the other end of the coin stack 2 to hold the stably rigid and tightly wrapped state of the packaged coin stack.

As described above, each auxiliary crimping hook of this invention is positioned in the vicinity of a main crimping hook and functions to positively grasp and press outward the folded edge of the wrapping sheet which has been folded by the main crimping hook and to present the folded edge of this state to the main crimping hook. Therefore, at the time of fold or roll crimping by means of the main crimping hook, sliding of the extreme edge of the folded projecting edge part of the sheet toward the center of the coin surface is prevented. Accordingly, even in the case where the projecting length of the projecting edge is long or even in the case where the wrapping sheet material is a synthetic resin such as cellophane or a polyethylene, positive and firm crimping is accomplished, and the force with which the coin stack is held tightly together is increased. Furthermore, since the projecting length is fully rolled inward, the appearance of the resulting bead is good. Still another desirable result is that the area of the exposed part of the coin surface at each end of the stack is increased, whereby identification of the denomination of the coins is facilitated. In addition, when the projecting length of the projecting edge is short, this edge can be directly rolled into a tight roll without folding.

While, in the foregoing embodiments of the invention, an example wherein the crimping hook 10 rolls the projecting edge 1*a* inward is illustrated in FIG. 8, and an example wherein it folds the projecting edge inward is illustrated in FIG. 17, it cannot be stated categorially which kind of crimping action will be carried out since it depends on the packaging mechanism, the composition and kind of wrapping sheet, the wrapping speed, and the packaging conditions during the packaging cycle. It is a fact, however, that either kind of crimping (either fold crimping or roll crimping) is carried out.

Figure 18:
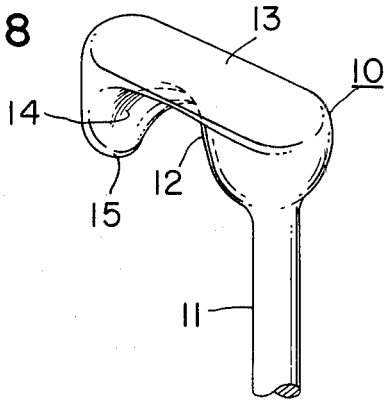
FIGS. 18 and 19 are respectively a perspective view and a plan view showing a third example of a crimping hook according to the invention which does not have the curved edge part provided in the crimping hooks of the preceding examples.
Figure 19:
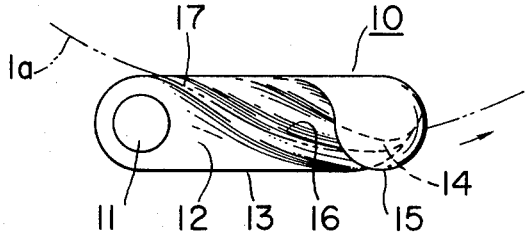

In a third embodiment of this invention as illustrated in FIGS. 18 and 19, the curved head 13 of the main crimping hook 10 does not have a curved edge part 18 as in the preceding first and second embodiments of the invention. In other respects, this crimping hook is the same as those of the preceding embodiments of the invention.

I claim:

1. In a coin packaging machine operating to wrap a piece of wrapping sheet material around the cylindrical surface of a coin stack and to fold or roll crimp projecting edges of the sheet material at the ends of the coin stack thereby to form a tightly wrapped coin package, a pair of crimping devices each having at least a main crimping hook comprising a shank position, during crimping, alongside and substantially parallel to the wrapped coin stack and a curved head joined at a proximal part thereof integrally to an outer end of the shank and extending substantially perpendicularly therefrom to a distal end, the curved head having an inner guide surface of twisted shape including a convolute groove-shaped slide surface and adapted to straddle obliquely across a respective one of said projecting edges undergoing rotation together with the coin stack during crimping, whereby said projecting edge is compelled, when pressed by the inner guide surface, to slide against and along said slide surface thereby to be curled and crimped inward toward the centerline of the coin stack and to be formed into an annular bead.

2. In a coin packaging machine operating to wrap a coin stack with a piece of wrapping sheet material and to fold or roll crimp projecting edges of the sheet material at the two ends of the coin stack thereby to form a tightly wrapped coin package, a pair of crimping hook devices, each device having at least a main crimping hook adapted to crimp a respective one of said projecting edges as the wrapped coin stack is rotated about its centerline axis and comprising a shank and a curved head joined at a proximal part thereof integrally to an outer end of the shank and extending substantially perpendicularly therefrom to a distal end, the curved head having: an inner guide surface of concave substantially arcuate shape as viewed in side view; a concave surface having an arcuate shape as viewed in section taken along a plane passing through the axis of the shank and formed on a side face at a part near said distal end to contact said sheet material; a curved tip part formed at the distal end; a groove-shaped slide surface formed in and obliquely across said inner guide surface to adjoin at one end thereof said concave surface and to extend therefrom to the outer end of the shank on the side thereof opposite from the concave surface, the inner guide surface thereby having a twisted shape; and a smooth inclined surface formed at said outer end of the shank to blend smoothly with said slide surface and facing in the direction opposite to that of the concave surface, the shank during operation being positioned closely alongside and substantially parallel to the wrapped coin stack, the curved head being adapted to extend obliquely across said respective projecting edge thereby to straddle the same during crimping, whereby said projecting edge is compelled, when pressed by the curved head, to slide against and along said groove-shaped slide surface thereby to be crimped inward toward the centerline of the coin stack and be formed into an annular bead.

3. A pair of crimping hook devices as claimed in claim 2 in which each curved head further has a curved edge surface having an arcuate concave shape as viewed in a direction parallel to the shank and formed on a flank of the curved head facing said centerline of the coin stack.

4. A pair of crimping hook devices as claimed in claim 1 in each of which there is further provided an auxiliary crimping hook fixed relative to the main crimping hook at a position such that, during crimping, said auxiliary crimping hook is on the inner side of said respective projecting edge and upstream from the main crimping hook with respect to the moving direction of the projecting edge, the auxiliary crimping hook having at a side part thereof a recessed smoothly curved surface and at an end part thereof a projecting edge part, said recessed smooth curved surface functioning to catch and press against a part of said projecting edge once rolled and curled by the main crimping hook thereby to cause the projecting edge to be crimped inward into a neat annular bead.

5. In a coin packaging machine operating to wrap a coin stack with a piece of wrapping sheet material and to fold or roll crimp projecting edges of the sheet material at the two ends of the coin stack thereby to form a tightly wrapped coin package, a pair of crimping hook devices, each device having at least a main crimping hook including a straight shank portion and a curved head portion formed integrally with said shank portion and extending outward in a direction substantially perpendicular to said shank portion; said curved head portion having:

- a root part joining said shank portion;
- an outer tip part curvedly extending from said curved head portion distal end to project laterally toward the inner surface of a wrapping sheet material positioned about a coin stack;
- an inner guide surface with a substantially arcuate concave shape;
- a concave surface adjacent said outer tip part, with a concave arcuate shape and adapted to contact the inner surface of the projecting edge of the wrapping sheet material projecting beyond an end of a coin stack;
- a groove-shaped slide surface extending obliquely across said inner guide surface and having a first end smoothly adjoining said concave surface and a second end adjacent said shank portion; and a flank formed with a curved edge of an arcuate concave shape and having, at the part thereof joining said flank, a smooth fair curved surface, one part of which has a shape following said groove-shaped slide surface and conformably adapted to a surface of a projecting edge of a wrapping sheet material.

6. In a coin packaging machine operating to wrap a coin stack with a piece of wrapping sheet material and to fold or roll crimp projecting edges of the sheet material at the two ends of the coin stack thereby to form a tightly wrapped coin package, a pair of crimping hook devices, each device having at least a main crimping hook including a straight shank portion and a curved head portion formed integrally with said shank portion and extending outward in a direction substantially perpendicular to said shank portion; said curved head portion having:

a root part joining said shank portion;

an outer tip part curvedly extending from said curved head portion distal end to project laterally toward the inner surface of a wrapping sheet material positioned about a coin stack;

an inner guide surface with a substantially arcuate concave shape;

a concave surface adjacent said outer tip part, with a concave arcuate shape and adapted to contact the inner surface of the projecting edge of the wrapping sheet material projecting beyond an end of a coin stack; and a groove-shaped slide surface extending obliquely across said inner guide surface and having a first end smoothly adjoining said concave surface and a second end adjacent said shank portion.

7. In a coin packaging machine operating to wrap a coin stack with a piece of wrapping sheet material and to fold or roll crimp projecting edges of the sheet material at the two ends of the coin stack thereby to form a tightly wrapped coin package, a pair of crimping hook devices, each device comprising a first crimping hook member including a straight shank portion and a curved head portion formed integrally with said shank portion and extending outward in a direction substantially perpendicular to said shank portion; said curved head portion having:

a root part joining said shank portion;

an outer tip part curvedly extending from said curved head portion distal end to project laterally toward the inner surface of a wrapping sheet material positioned about a coin stack;

an inner guide surface with a substantially arcuate concave shape;

a concave surface adjacent said outer tip part, with a concave arcuate shape and adapted to contact the inner surface of the projecting edge of the wrapping sheet material projecting beyond an end of a coin stack;

a groove-shaped slide surface extending obliquely across said inner guide surface and having a first end smoothly adjoining said concave surface and a second end adjacent said shank portion;

a flank formed with a curved edge of an arcuate concave shape and having, at the part thereof joining said flank, a smooth fair curved surface, one part of which has a shape following said groove-shaped slide surface and conformably adapted to a surface of a projecting edge of a wrapping sheet material; and a second crimping hook member adjacent said first crimping hook member at a position upstream therefrom with respect to the movement of the wrapping sheet material and on the inner side thereof, said second crimping hook member including a substantially cylindrical shaped body portion with a recessed, smoothly curved surface formed in one side thereof and facing in the same direction as said first crimping hook member groove-shaped slide surface, and with a projecting edge part at the outer end of said recessed smoothly curved surface, said projecting edge part projecting, at the same height as said first crimping hook member outer tip part, further toward the inner surface of the wrapping sheet material than said outer tip part.

* * * * *